US010704512B2

(12) United States Patent
Brackman et al.

(10) Patent No.: US 10,704,512 B2
(45) Date of Patent: Jul. 7, 2020

(54) SEGMENTED MANIFOLD HEAD CONNECTORS

(71) Applicant: CUMMINS INC., Columbus, IN (US)

(72) Inventors: Christopher A. Brackman, Columbus, IN (US); Scott R. Bardakjy, Columbus, IN (US); Robert M. Quarles, Seymour, IN (US)

(73) Assignee: Cummins Inc., Columbus, IN (US)

( * ) Notice: Subject to any disclaimer, the term of this patent is extended or adjusted under 35 U.S.C. 154(b) by 35 days.

(21) Appl. No.: 15/759,701

(22) PCT Filed: Sep. 16, 2016

(86) PCT No.: PCT/US2016/052126
§ 371 (c)(1),
(2) Date: Mar. 13, 2018

(87) PCT Pub. No.: WO2017/053194
PCT Pub. Date: Mar. 30, 2017

(65) Prior Publication Data

US 2019/0048835 A1 Feb. 14, 2019

Related U.S. Application Data

(60) Provisional application No. 62/221,753, filed on Sep. 22, 2015.

(51) Int. Cl.
*F02M 35/10* (2006.01)
*F02M 35/104* (2006.01)

(52) U.S. Cl.
CPC .... *F02M 35/10144* (2013.01); *F02M 35/104* (2013.01); *F02M 35/10078* (2013.01); *F02M 35/10354* (2013.01)

(58) Field of Classification Search
CPC ..... F02M 35/10144; F02M 35/10354; F02M 35/10078; F02M 35/104
See application file for complete search history.

(56) References Cited

U.S. PATENT DOCUMENTS 2,541,205 A * 2/1951 Christophersen ..... F16L 23/08 285/210
2,935,342 A 5/1960 Seamark et al.
(Continued)

FOREIGN PATENT DOCUMENTS

AU 2009233611 5/2011
DE 69207508 8/1996
(Continued)

OTHER PUBLICATIONS

Extended Search Report from corresponding EP Patent Application No. 16849379.9, dated Apr. 3, 2019, pp. 1-8.
(Continued)

*Primary Examiner* — Jacob M Amick
*Assistant Examiner* — Charles Brauch
(74) *Attorney, Agent, or Firm* — Foley & Lardner LLP

(57) ABSTRACT

Intake manifold-cylinder head connectors and methods of assembling the same are disclosed. A distal jumper tube includes a distal jumper tube conduit with an upstream end having a first exterior engagement feature and a downstream end. A proximal jumper tube includes a proximal jumper tube conduit with an upstream end and a downstream end having a second exterior engagement feature. A middle jumper tube includes a middle jumper tube conduit with an upstream end having a third exterior engagement feature, and a downstream end having a fourth engagement feature. The first exterior engagement feature is removably coupled to the fourth exterior engagement feature, and the second exterior engagement feature is removably engaged to the third exterior engagement feature. The proximal jumper tube
(Continued)

is in fluid receiving communication with an intake manifold conduit, and the distal jumper tube is in fluid providing communication with a cylinder head aperture.

16 Claims, 3 Drawing Sheets

(56) References Cited

U.S. PATENT DOCUMENTS

| | | | | |
|---|---|---|---|---|
| 4,346,428 | A | 8/1982 | Gale | |
| 2004/0003792 | A1 | 1/2004 | Kono | |
| 2006/0185639 | A1* | 8/2006 | Rosenbaum ..... | F02M 35/10137 123/184.21 |
| 2007/0221169 | A1 | 9/2007 | Konno | |
| 2009/0165741 | A1 | 7/2009 | Kubo et al. | |

FOREIGN PATENT DOCUMENTS

| | | |
|---|---|---|
| DE | 20 2006 016 187 | 10/2006 |
| EP | 2 463 569 | 6/2012 |

OTHER PUBLICATIONS

International Search Report from corresponding PCT Application No. PCT/US2016/052126, dated Nov. 30, 2016, pp. 1-2.
Written Opinion from corresponding PCT Application No. PCT/US2016/052126, dated Nov. 30, 2016, pp. 1-6.

* cited by examiner

SEGMENTED MANIFOLD HEAD CONNECTORS

CROSS-REFERENCE TO RELATED APPLICATIONS

This application is the U.S. National Stage of PCT Application No. PCT/US2016/052126, filed Sep. 16, 2016, which claims the benefit of and priority to U.S. Provisional Patent Application No. 62/221,753, filed on Sep. 22, 2015, the contents of which are incorporated herein by reference in their entirety.

TECHNICAL FIELD

The present disclosure relates to internal combustion engines.

BACKGROUND

Internal combustion engines generally rely on a consistent and sufficient provision of air to combustion cylinders. To that end, internal combustion engines commonly incorporate air intake assemblies. Air intake assemblies route air from the atmosphere to corresponding intake manifolds, which in turn route air to cylinder heads. A given cylinder head regulates airflows to individual combustion cylinders of an internal combustion engine.

A proper engagement of an intake manifold to a corresponding cylinder head is an important aspect of providing a consistent and sufficient flow of air to an internal combustion engine. Over time, junctions at the intake manifold and the cylinder head need to be serviced. For example, seals at each junction may dry out or otherwise wear out, giving rise to air leaks. Servicing these junctions usually entails removing entire intake manifolds and/or cylinder heads, which often involves a significant amount of time and energy.

SUMMARY

One embodiment relates to a manifold-head connector assembly. The assembly includes a distal jumper tube comprising a distal jumper tube conduit defining an inner bore, an upstream end, and a downstream end, the upstream end having a first exterior engagement feature. The assembly further includes a proximal jumper tube comprising a proximal jumper tube conduit defining an inner bore, an upstream end, and a downstream end, the downstream end having a second exterior engagement feature. The assembly includes a middle jumper tube comprising a middle jumper tube conduit defining an inner bore, an upstream end, and a downstream end, the upstream end and the downstream end having a third exterior engagement feature and a fourth engagement feature, respectively. The first exterior engagement feature is removably coupled to the fourth exterior engagement feature, and the second exterior engagement feature is removably engaged to the third exterior engagement feature. The proximal jumper tube is in fluid receiving communication with an intake manifold conduit, and the distal jumper tube is in fluid providing communication with a cylinder head aperture.

Another embodiment relates to a method of assembling an intake manifold-cylinder head connector. The method includes positioning a distal jumper tube in an internal combustion engine, wherein the distal jumper tube comprises a distal jumper tube conduit defining an inner bore, an upstream end having a first exterior engagement feature, and a downstream end, and wherein the downstream end is inserted into a cylinder head aperture. The method further includes positioning a proximal jumper tube in the internal combustion engine, wherein the proximal jumper tube comprises a proximal jumper tube conduit defining an inner bore, an upstream end, and a downstream end having a second exterior engagement feature, and wherein the upstream end is inserted into an intake manifold conduit. The method includes positioning a middle jumper tube in an internal combustion engine, wherein the middle jumper tube comprises a middle jumper tube conduit defining an inner bore, an upstream end having a third exterior engagement feature, and a downstream end having a fourth exterior engagement feature, and wherein the middle jumper tube is positioned between the distal jumper tube and the proximal jumper tube. The method further includes coupling the first exterior engagement feature to the fourth exterior engagement feature, and coupling the second exterior engagement feature to the third exterior engagement feature.

Another embodiment relates to an engine assembly comprising a manifold-head connector assembly. The manifold-head connector assembly is structured to connect between an intake manifold and a cylinder head and direct air flow from the intake manifold to the cylinder head. The manifold-head connector assembly comprises a proximal jumper tube, a middle jumper tube, and a distal jumper tube. The proximal jumper tube is removably engaged to the intake manifold and structured to receive airflow from the intake manifold. The middle jumper tube is removably engaged to the proximal jumper tube and structured to receive the airflow from the proximal jumper tube. The distal jumper tube is removably engaged to the middle jumper tube at one end and removably engaged to the cylinder head at the other end. The distal jumper tube is structured to receive the airflow from the middle jumper tube and direct the airflow to the cylinder head.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein.

BRIEF DESCRIPTION OF THE DRAWINGS

The skilled artisan will understand that the drawings primarily are for illustrative purposes and are not intended to limit the scope of the subject matter described herein. The drawings are not necessarily to scale; in some instances, various aspects of the subject matter disclosed herein may be shown exaggerated or enlarged in the drawings to facilitate an understanding of different features. In the drawings, like reference characters generally refer to like features (e.g., functionally similar and/or structurally similar elements).

The features and advantages of the inventive concepts disclosed herein will become more apparent from the detailed description set forth below when taken in conjunction with the drawings.

DETAILED DESCRIPTION

Following below are more detailed descriptions of various concepts related to, and embodiments of, inventive connectors for coupling intake manifolds to cylinder heads in internal combustion engines. It should be appreciated that various concepts introduced above and discussed in greater detail below may be implemented in any of numerous ways, as the disclosed concepts are not limited to any particular manner of implementation. Examples of specific implementations and applications are provided primarily for illustrative purposes.

Figure 1:
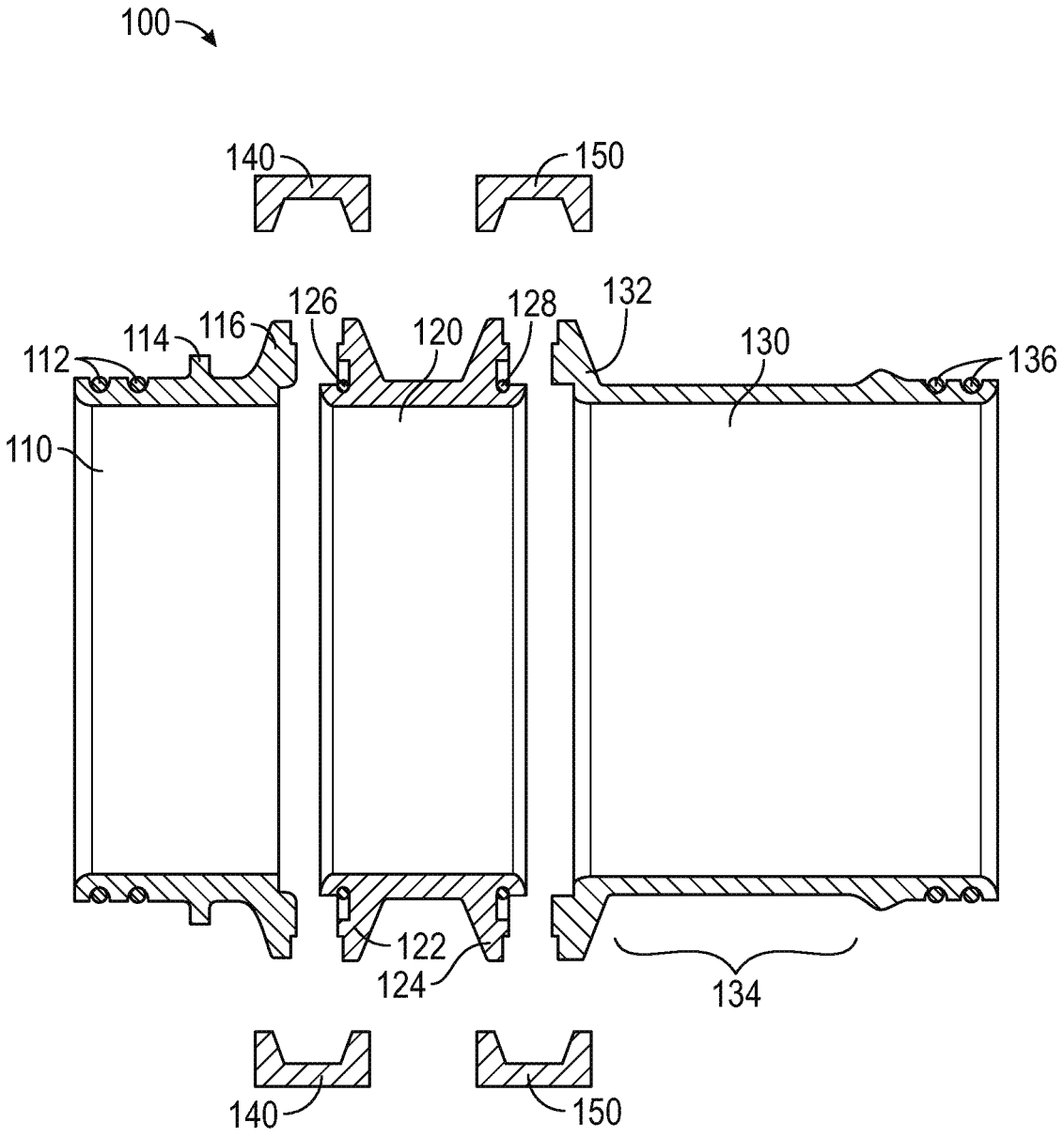
FIG. 1 is an exploded, cross-sectional side view of a manifold-head connector assembly, according to an example embodiment.

Referring now to FIG. 1, a manifold-head connector assembly 100 is configured to communicatively couple an intake manifold to a cylinder head of an internal combustion engine. The manifold-head connector assembly 100 provides an airflow conduit that may be assembled and disassembled in a piecemeal manner, providing for increased serviceability of internal combustion engines. For example, the manifold-head connector assembly 100 allows individual intake manifold-cylinder junctions to be serviced individually (e.g., to replace seals), thereby avoiding a need to remove either the entire intake manifold or the cylinder head for service.

The manifold-head connector assembly 100 includes a proximal jumper tube 110, a middle jumper tube 120, and a distal jumper tube 130. Each of the proximal jumper tube 110, the middle jumper tube 120, and the distal jumper tube 130 comprises a hollow conduit segment having an interior bore with a predominantly smooth inner wall. In addition, in some arrangements, each jumper tube includes exterior engagement features disposed at an exterior surface. Some of the exterior features facilitate an engagement with another jumper tube, and other exterior features facilitate an engagement with a cylinder head airflow aperture or an intake manifold conduit aperture. For example, in one arrangement, each of the jumper tubes includes an annular flange disposed about an exterior circumference at an end configured to engage another jumper tube (e.g., a first flange 116 of the proximal jumper tube 110, a first flange 122 and a second flange 124 of the middle jumper tube 120, and a first/distal jumper flange 132 of the distal jumper tube 130, as discussed in more detail below).

The proximal jumper tube 110 is an airflow conduit that engages an aperture of an intake manifold at a first end, and the middle jumper tube 120 at a second end. The proximal jumper tube 110 includes at least one proximal jumper seal 112, a hard stop 114, and a proximal jumper flange 116. The proximal jumper seal 112 serves to provide an airtight or near-airtight seal between the proximal jumper tube 110 and a corresponding aperture at an intake manifold. The term "near-airtight" refers to an arrangement where only a de minimis amount of air is capable of escaping from the seal, without adversely affecting the overall functionality of the system. The proximal jumper seal 112 is a deformable band of material (e.g., rubber, pliable metals, fibers or meshes, etc.) annularly disposed about the external circumference of the first end (i.e., an end that does not engage another jumper tube) of the proximal jumper tube 110. Examples of the proximal jumper seal 112 include O-rings, D-rings, J-seals, rectangular cross section seals, etc. In some arrangements, the proximal jumper seal 112 is disposed in an annular groove disposed in the outer circumference of the proximal jumper tube 110, such that a portion of the proximal jumper seal 112 protrudes out of the annular groove.

In some arrangements, the proximal jumper tube 110 includes the hard stop 114. The hard stop 114 serves to limit a translation of a receiving intake manifold conduit or cylinder head aperture along the first end of the proximal jumper tube 110. The hard stop 114 is a protrusion extending laterally from the exterior surface of the proximal jumper tube 110. In some arrangements, the hard stop 114 is an annular protrusion disposed about the exterior circumference of the proximal jumper tube 110. In other arrangements, the hard stop 114 is one or more pegs, blocks, or other non-continuous protrusions extending from the exterior surface of the proximal jumper tube 110. As such, the first end of the proximal jumper tube 110 may translate into and through a receiving conduit or aperture until the hard stop 114 contacts the receiving conduit.

The proximal jumper flange 116 is a feature of the proximal jumper tube 110 that facilitates a removable engagement between the proximal jumper tube 110 and the middle jumper tube 120. In one arrangement, the proximal jumper flange 116 is an annular protrusion disposed about an exterior circumference at the second end (i.e., the end engaging the middle jumper tube 120) of the proximal jumper tube 110. In another arrangement, the proximal jumper flange 116 is a non-continuous protrusion extending laterally from the exterior surface at the second end of the proximal jumper tube 110 (e.g., to which one or more clips can engage). The proximal jumper flange 116 may be configured to removably engage a corresponding clamp (e.g., a V-clamp, a Marman clamp, etc.), one or more clips, or the like. The proximal jumper flange 116 may also include a set of threads or bolt holes configured to mate with corresponding threads or bolt holes on the middle jumper tube 120.

The middle jumper tube 120 is an intermediate airflow conduit configured to removably bridge an airflow from the proximal jumper tube 110 to the distal jumper tube 130. The middle jumper tube 120 includes a first flange 122, a second flange 124, a first middle jumper seal 126, and a second middle jumper seal 128. The first flange 122 is disposed at a first end of the middle jumper tube 120 (i.e., the end configured to removably engage the proximal jumper tube 110) and is configured to complement the proximal jumper flange 116. For example, where the proximal jumper flange 116 is configured to be engaged by a Marman clamp, the first flange 122 is also configured to be engaged by the Marman clamp. In turn, the second flange 124 is configured to complement a distal jumper flange 132 in a similar manner. As such, the first flange 122 and the second flange 124 facilitate removable engagements with the proximal jumper tube 110 and the distal jumper tube 130, respectively.

The first middle jumper seal 126 and the second middle jumper seal 128 serve to provide airtight or near-airtight seals at the proximal jumper tube 110-middle jumper tube 120 junction and the middle jumper tube 120-distal jumper tube 130 junction, respectively. Each middle jumper seal 126, 128 may be disposed in a respective annular channel disposed about an exterior circumference of the middle jumper tube 120. As such, for example, an exterior feature of the proximal jumper tube 110 (e.g., the proximal jumper flange 116) may engage and compress an exposed portion of the first middle jumper seal 126, thereby forming an airtight seal. In some arrangements, seals serving a similar purpose to the middle jumper seals 126, 128 may be disposed at the proximal jumper tube 110 and the distal jumper tube 130 instead of the middle jumper tube 120. In such an arrangement, an exterior feature of the middle jumper tube 120 (e.g., the first flange 122) may engage and compress an exposed portion of a seal on the proximal jumper tube 110 to form an airtight seal in a similar fashion.

The distal jumper tube 130 is an airflow conduit that engages the middle jumper tube 120 at a first end and an aperture of a cylinder head at a second end. The distal jumper tube 130 includes a distal jumper flange 132, a translation surface 134, and at least one distal jumper seal 136. Similar to the proximal jumper flange 116, the distal jumper flange 132 is a feature of the distal jumper tube 130 at the first end that facilitates a removable engagement between the distal jumper tube 130 and the middle jumper tube 120. As mentioned above, the distal jumper flange 132 complements the second flange 124 of the middle jumper tube 120. Similar to the proximal jumper seal 112, the distal jumper seal 136 serves to provide an airtight or near-airtight seal between the distal jumper tube 130 and a corresponding aperture at a cylinder head. The distal jumper seal 136 is a deformable band of material annularly disposed about the external circumference of the second end of the distal jumper tube 130, and may be disposed in an annular channel.

The translation surface 134 is a portion of the exterior surface of the distal jumper tube 130 that is substantially smooth and free of protrusions. As such, a component annularly disposed about the distal jumper tube 130 (e.g., a receiving cylinder head aperture) may translate along the length of the translation surface 134. In some arrangements, a translation surface is disposed at the proximal jumper tube 110 as well.

In some arrangements, the manifold-head connector assembly 100 includes a first clamp 140 and a second clamp 150. The first clamp 140 and the second clamp 150 are configured to secure a proximal jumper tube 110-middle jumper tube 120 engagement and a middle jumper tube 120-distal jumper tube 130 engagement respectively. In some arrangements, each clamp is configured to engage flanges at each of the jumper tubes. In one example arrangement, the first clamp 140 is a Marmon clamp configured to engage both the proximal jumper flange 116 and the first flange 122. In turn, the second clamp 150 may be another Marmon clamp configured to engage both the second flange 124 and the distal jumper flange 132. As one of skill in the art would recognize, various types of clamps, clips, and other removable fasteners may be used to engage one or more of the flanges of the manifold-head connector assembly 100.

Figure 2:
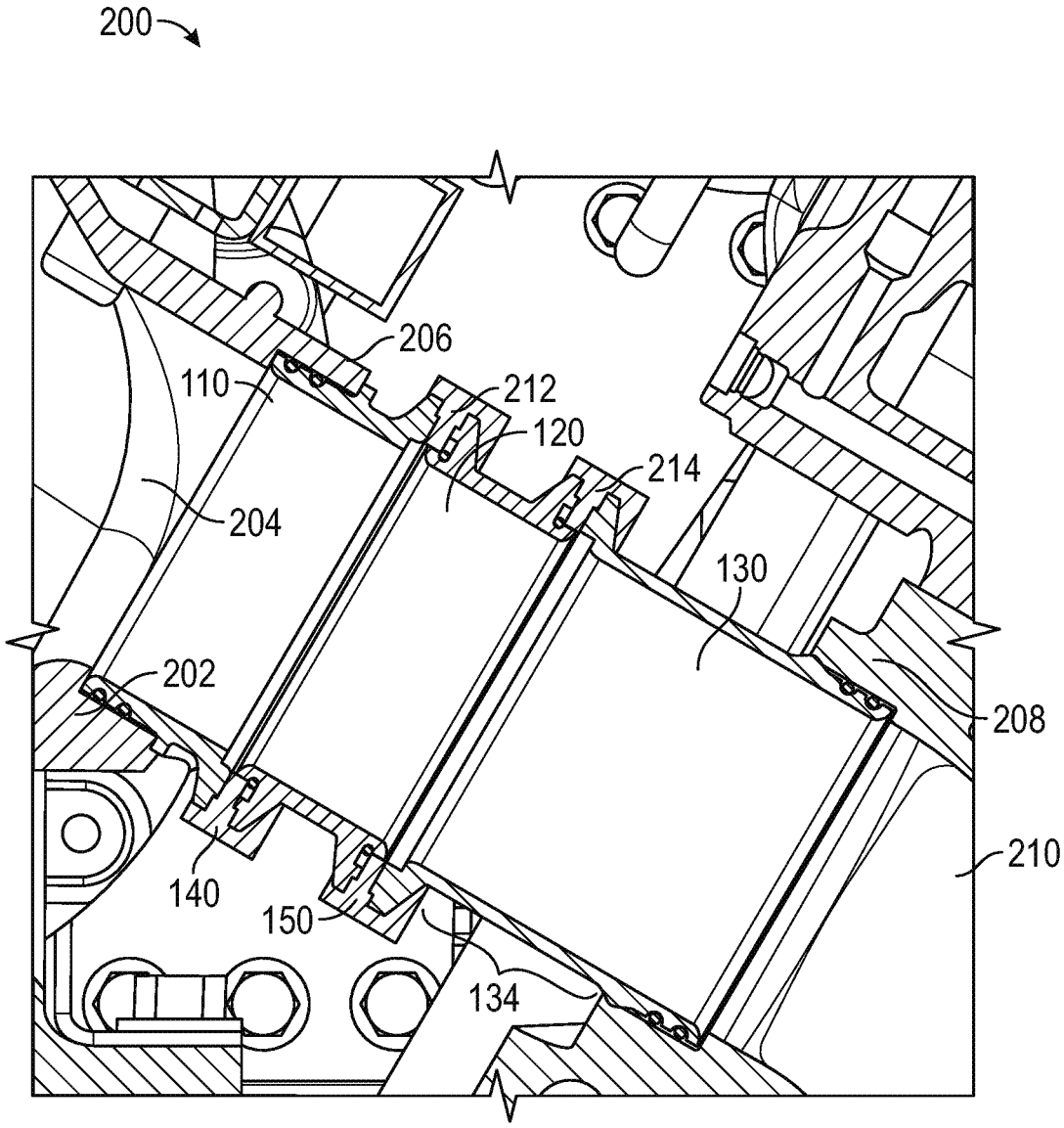
FIG. 2 is the manifold-head connector assembly shown in FIG. 1 coupled to an intake manifold and a cylinder head.

Shown in FIG. 2 is a portion of an engine assembly 200 incorporating the manifold-head connector assembly 100 of FIG. 1. The portion of the engine assembly 200 shown includes a portion of an intake manifold 202 and a portion of a cylinder head 208. The intake manifold 202 includes a terminal end of an intake manifold conduit 204, and the cylinder head 208 includes a cylinder head aperture 210. The terminal end of the intake manifold conduit 204 includes a chamfer 206, which is a funnel-shaped interior mating surface configured to facilitate a reception of the proximal jumper tube 110. In some arrangements, another chamfer is disposed at the cylinder head aperture 210 as well.

As shown, the middle jumper tube 120 is coupled to the proximal jumper tube 110 at an upstream end and the distal jumper tube 130 at a downstream end. An upstream end of the proximal jumper tube 110 is disposed in the intake manifold conduit 204, and a downstream end of the distal jumper tube 130 is disposed in the cylinder head aperture 210. As such, with the manifold-head connector assembly 100 of FIG. 1 in place, air can flow from the intake manifold 202 to the cylinder head 208.

The first clamp 140 secures the coupling of the proximal jumper tube 110 to the middle jumper tube 120 at corresponding flanges, and the second clamp 150 secures the coupling of the distal jumper tube 130 to the middle jumper tube 120 at corresponding flanges. In some arrangements, coupling the flanges at each jumper tube gives rise to a first pry slot 212 and a second pry slot 214. In one such arrangement, the first pry slot 212 is a wedge-shaped gap between a flange at the proximal jumper tube 110 and a flange at the middle jumper tube 120. Removal of the first clamp 140 exposes the first pry slot 212. As such, to separate the proximal jumper tube 110 from the middle jumper tube 120, a tool (e.g., a flat head screwdriver) may be inserted into the first pry slot 212 and leveraged to pry the flanges apart.

The use of the manifold-head connector assembly 100 allows for a greater degree of manufacturing and assembly tolerances with respect to the intake manifold 202 and the cylinder head 208. Varying dimensions of manifold-head connector assembly 100 components (e.g., jumper lengths) and/or the translation surface 134 may allow for significant variances in the distance between mating portions of the intake manifold 202 and the cylinder head 208 across a plurality of engines. For example, an upstream portion of the intake manifold 202 may be directly bolted to the block portion (not shown) of the engine 200, anchoring the upstream end of the intake manifold 202 in place and allowing the intake manifold 202 to serve as a load bearing structure. In such an arrangement, conventional approaches to joining the intake manifold 202 to the cylinder head 208 would require strict or narrow tolerances to properly couple the downstream end of the intake manifold 202 to the cylinder head 208. In contrast, the manifold-head connector assembly 100 allows the intake manifold 202 to be coupled to the cylinder head 208 within a range of distances (e.g., defined by the dimensions of the manifold-head connector assembly 100).

Figure 3:
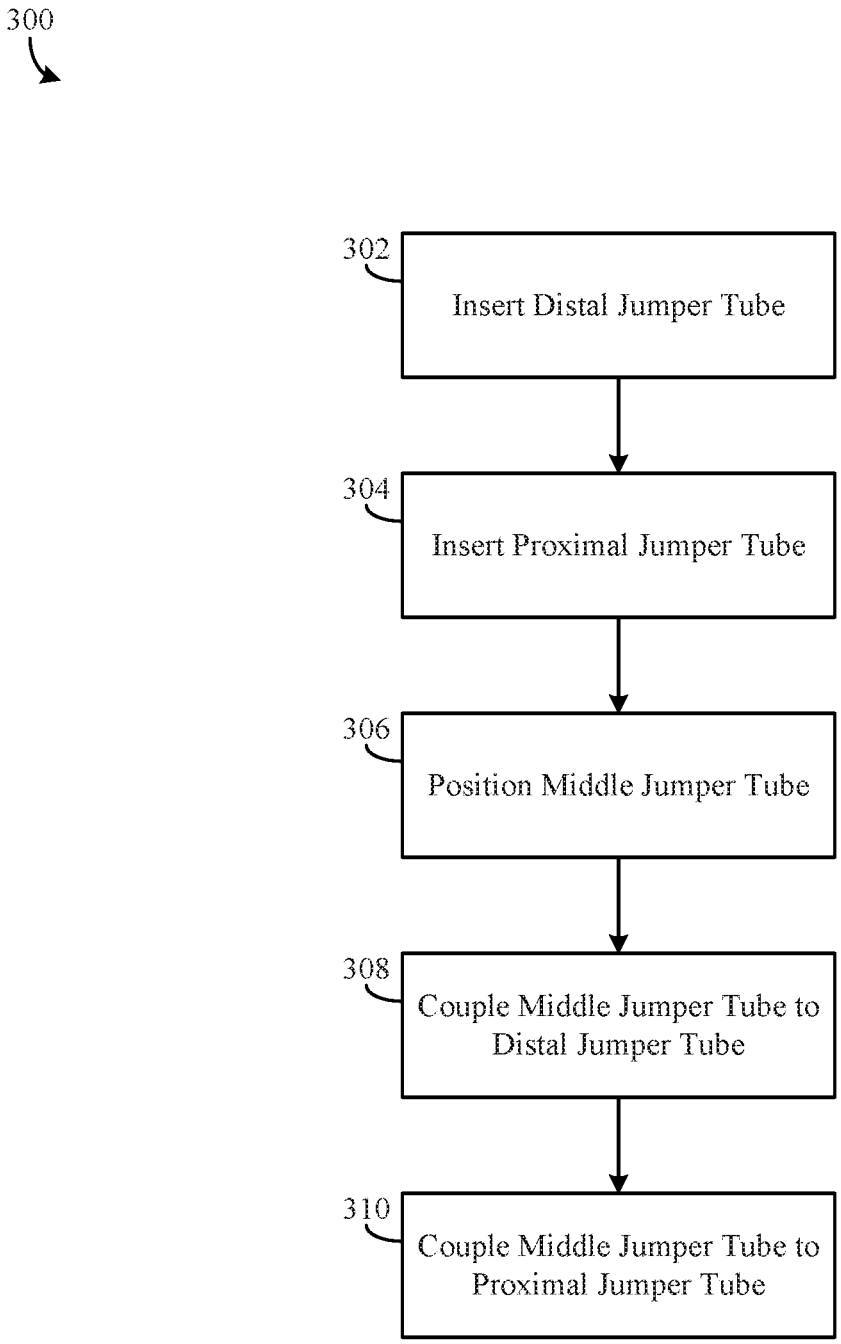
FIG. 3 is a flow diagram showing a method of assembling a manifold-head connector, according to an example embodiment.

FIG. 3 illustrates a flow diagram of a method 300 of assembling the manifold-head connector assembly 100 of FIG. 1 in an engine assembly. At 302, a downstream end (i.e., with respect to an intake air flow) of a distal jumper tube (e.g., the distal jumper tube 130) is inserted into a cylinder head (e.g., the cylinder head 208). The downstream end of the distal jumper tube is inserted into a cylinder head aperture (e.g., the cylinder head aperture 210) at the cylinder head. The distal jumper tube includes at least one distal jumper seal (e.g., the distal jumper seal 136), facilitating an airtight or near-airtight seal between the distal jumper tube and the cylinder head aperture. In some arrangements, the cylinder head aperture includes a chamfer that facilitates the insertion of the distal jumper tube. Further, in some arrangements, the distal jumper tube is inserted into the cylinder head aperture and translated along a translation surface (e.g., the translation surface 134) to provide room sufficient for the installation of additional jumper tubes.

At 304, an upstream end of a proximal jumper tube (e.g., the proximal jumper tube 110) is inserted into an intake manifold conduit (e.g., the intake manifold conduit 204). In some arrangements, the insertion of the proximal jumper tube is facilitated by a chamfer (e.g., the chamfer 206), and an airtight or near-airtight seal is created with at least one proximal jumper seal (e.g., the proximal jumper seal 112).

At 306, a middle jumper tube (e.g., the middle jumper tube 120) is positioned between an upstream end of the distal jumper tube and a downstream end of the proximal jumper tube. The middle jumper tube is positioned such that a continuous airflow conduit is formed through the proximal jumper tube, the middle jumper tube, and the distal jumper tube. In some arrangements, the distal jumper tube is translated out of the cylinder head aperture along the translation surface to contact the middle jumper tube.

At 308, a downstream end of the middle jumper tube is coupled to the upstream end of the distal jumper tube. In one arrangement, the middle jumper tube is coupled to the distal jumper tube via a clamp (e.g., the first clamp 140). In some such arrangements, the clamp is a Marman clamp configured to engage corresponding flanges at the distal jumper tube and the middle jumper tube. In other arrangements, the middle jumper tube is coupled to the distal jumper tube via complementary sets of threads at both tubes.

At 310, an upstream end of the middle jumper tube is coupled to the downstream end of the proximal jumper tube. The middle jumper tube is coupled to the proximal jumper tube in a manner similar to that discussed at 308.

For the purpose of this disclosure, the term(s) "engaged" and "coupled" means the joining of two members directly or indirectly to one another. Such joining may be stationary or moveable in nature. Such joining may be achieved with the two members or the two members and any additional intermediate members being integrally formed as a single unitary body with one another or with the two members or the two members and any additional intermediate members being attached to one another. Such joining may be permanent in nature or may be removable or releasable in nature.

It should be noted that the orientation of various elements may differ according to other exemplary embodiments, and that such variations are intended to be encompassed by the present disclosure. It is recognized that features of the disclosed embodiments can be incorporated into other disclosed embodiments.

It is important to note that the constructions and arrangements of apparatuses or the components thereof as shown in the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter disclosed. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present disclosure.

While various inventive embodiments have been described and illustrated herein, those of ordinary skill in the art will readily envision a variety of other mechanisms and/or structures for performing the function and/or obtaining the results and/or one or more of the advantages described herein, and each of such variations and/or modifications is deemed to be within the scope of the inventive embodiments described herein. More generally, those skilled in the art will readily appreciate that, unless otherwise noted, any parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

Also, the technology described herein may be embodied as a method, of which at least one example has been provided. The acts performed as part of the method may be ordered in any suitable way unless otherwise specifically noted. Accordingly, embodiments may be constructed in which acts are performed in an order different than illustrated, which may include performing some acts simultaneously, even though shown as sequential acts in illustrative embodiments.

The claims should not be read as limited to the described order or elements unless stated to that effect. It should be understood that various changes in form and detail may be made by one of ordinary skill in the art without departing from the spirit and scope of the appended claims. All embodiments that come within the spirit and scope of the following claims and equivalents thereto are claimed.

The invention claimed is:

1. A manifold-head connector assembly comprising:

a distal jumper tube in fluid communication with a cylinder head aperture, the distal jumper tube comprising a distal jumper tube conduit defining an inner bore, an upstream end, and a downstream end, the upstream end having a first exterior engagement feature;

a proximal jumper tube comprising a proximal jumper tube conduit defining an inner bore, an upstream end, and a downstream end, the downstream end having a second exterior engagement feature;

a middle jumper tube comprising a middle jumper tube conduit defining an inner bore, an upstream end, and a downstream end, the upstream end and the downstream end having a third exterior engagement feature and a fourth exterior engagement feature, respectively, the third exterior engagement feature removably coupled to the second exterior engagement feature, the fourth exterior engagement feature removably engaged to the first exterior engagement feature, wherein the first exterior engagement feature comprises a first flange, the second exterior engagement feature comprises a second flange, the third exterior engagement feature comprises a third flange, and the fourth exterior engagement feature comprises a fourth flange;

a first pry slot formed between the first flange and the fourth flange; and a second pry slot formed between the second flange and the third flange.

2. The assembly of claim 1, wherein the fourth flange is complementary with the first flange.

3. The assembly of claim 1, wherein the third flange is complementary with the second flange.

4. The assembly of claim 1, wherein a first clamp removably engages the first exterior engagement feature to the fourth exterior engagement feature; wherein a second clamp removably engages the second exterior engagement feature to the third exterior engagement feature, wherein the first clamp covers the first pry slot, and wherein the second clamp covers the second pry slot.

5. The assembly of claim 4, wherein each of the first clamp and the second clamp comprise Marman clamps.

6. The assembly of claim 1, wherein the middle jumper tube conduit is structured to removably bridge an airflow from the proximal jumper tube to the distal jumper tube.

7. The assembly of claim 1, wherein each of the proximal jumper tube, the distal jumper tube, and the middle jumper tube comprises at least one jumper seal.

8. The assembly of claim 7, wherein each jumper seal provides an airtight or near-airtight seal between two of the proximal jumper tube, the middle jumper tube, or the distal jumper tube, or provides an airtight or near-airtight seal between the cylinder head aperture and a the distal jumper tube.

9. The assembly of the claim 8, wherein one or more of the at least one jumper seal is annularly disposed about an external circumference of a corresponding one of the proximal jumper tube, the middle jumper tube, and the distal jumper tube.

10. A method of assembling a manifold-head connector assembly, the method comprising:

positioning a distal jumper tube, the distal jumper tube comprising a distal jumper tube conduit defining an inner bore, an upstream end having a first exterior engagement feature, and a downstream end, and wherein the downstream end is inserted into a cylinder head aperture;

positioning a proximal jumper tube, the proximal jumper tube comprising a proximal jumper tube conduit defining an inner bore, an upstream end, and a downstream end having a second exterior engagement feature, and wherein the upstream end is inserted into an intake manifold conduit;

positioning a middle jumper tube between the distal jumper tube and the proximal jumper tube, wherein the middle jumper tube comprises a middle jumper tube conduit defining an inner bore, an upstream end having a third exterior engagement feature, and a downstream end having a fourth exterior engagement feature;

coupling the first exterior engagement feature to the fourth exterior engagement feature;

coupling the second exterior engagement feature to the third exterior engagement feature;

translating the distal jumper tube into the cylinder head aperture before positioning the middle jumper tube; and translating the distal jumper tube out of the cylinder head aperture after positioning the middle jumper tube.

11. The method of claim 6, further comprising fastening a first clamp to the first exterior engagement feature and the fourth exterior engagement feature; and fastening a second clamp to the second exterior engagement feature and the third exterior engagement feature.

12. The method of claim 7, wherein each of the first clamp and the second clamp is a Marman clamp.

13. An engine assembly comprising:

a manifold-head connector assembly structured to connect between an intake manifold and a cylinder head and direct air flow from the intake manifold to the cylinder head, the manifold-head connector assembly comprising:

a proximal jumper tube removably engaged to the intake manifold and structured to receive an airflow from the intake manifold;

a middle jumper tube removably engaged to the proximal jumper tube and structured to receive the airflow from the proximal jumper tube; and a distal jumper tube removably engaged to the middle jumper tube at one end and removably engaged to the cylinder head at the other end, the distal jumper tube structured to receive the airflow from the middle jumper tube and direct the airflow to the cylinder head, wherein the proximal jumper tube comprises a proximal jumper tube conduit defining an inner bore, an upstream end, and a downstream end, the upstream end having a first exterior engagement feature, the downstream end having a second exterior engagement feature removably coupled to the middle jumper tube, wherein the middle jumper tube comprises a middle jumper tube conduit defining an inner bore, an upstream end, and a downstream end, the upstream end having a third exterior engagement feature removably coupled to the second exterior engagement feature, the downstream end having a fourth exterior engagement feature removably coupled to the distal jumper tube, and wherein the first exterior engagement feature comprises a first flange, the second exterior engagement feature comprises a second flange, the third exterior engagement feature comprises a third flange, and the fourth exterior engagement feature comprises a fourth flange, and wherein the assembly further comprises a first pry slot formed between the first flange and the fourth flange, and a second pry slot formed between the second flange and the third flange.

14. The engine assembly of claim 13, wherein the distal jumper tube comprises a distal jumper tube conduit defining an inner bore, an upstream end, and a downstream end, the upstream end comprising a fifth exterior engagement feature removably coupled to the fourth exterior engagement feature, the downstream end comprising a sixth exterior engagement feature.

15. The engine assembly of claim 14, wherein at least one of the first, second, third, fourth, fifth or sixth exterior engagement features comprises at least one jumper seal structured to provide an airtight or near-airtight seal.

16. The assembly of the claim 15, wherein the at least one jumper seal is annularly disposed about an external circumference of a corresponding one of the proximal jumper tube, the middle jumper tube, or the distal jumper tube.

* * * * *